US008848000B2

(12) United States Patent
Minami et al.

(10) Patent No.: US 8,848,000 B2
(45) Date of Patent: Sep. 30, 2014

(54) DISPLAY DEVICE, METHOD OF DRIVING THE DISPLAY DEVICE, AND ELECTRONIC DEVICE

(75) Inventors: Tetsuo Minami, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 719 days.

(21) Appl. No.: 13/005,925

(22) Filed: Jan. 13, 2011

(65) Prior Publication Data

US 2011/0181629 A1 Jul. 28, 2011

(30) Foreign Application Priority Data

Jan. 28, 2010 (JP) ..... P2010-016888

(51) Int. Cl.
*G09G 5/10* (2006.01)
*G09G 3/32* (2006.01)

(52) U.S. Cl.
CPC ..... *G09G 3/3233* (2013.01); *G09G 2300/0866* (2013.01); *G09G 2320/043* (2013.01); *G09G 2300/0842* (2013.01); *G09G 2310/0218* (2013.01); *G09G 3/3266* (2013.01); *G09G 2310/04* (2013.01); *G09G 2300/0819* (2013.01)
USPC ..... 345/690; 345/692

(58) Field of Classification Search
CPC ..... G06G 3/3233; G06G 3/3266; G06G 2300/0819; G06G 2300/0866; G06G 2300/0842; G06G 2310/04; G06G 2310/0218; G06G 2320/043
USPC ..... 345/76–100, 204–212, 657, 690, 692; 315/169.3; 709/206; 382/165, 209
See application file for complete search history.

(56) References Cited

U.S. PATENT DOCUMENTS

| | | | | |
|---|---|---|---|---|
| 4,642,524 | A * | 2/1987 | Eaton et al. | 315/169.3 |
| 4,656,467 | A * | 4/1987 | Strolle | 345/657 |
| 4,779,083 | A * | 10/1988 | Ishii et al. | 345/692 |
| 5,075,596 | A * | 12/1991 | Young et al. | 315/169.3 |
| 5,570,691 | A * | 11/1996 | Wright et al. | 600/447 |
| 5,703,621 | A * | 12/1997 | Martin et al. | 345/690 |
| 6,950,081 | B2 * | 9/2005 | Akimoto et al. | 345/55 |
| 7,039,229 | B2 * | 5/2006 | Lin et al. | 382/165 |
| 7,236,147 | B2 * | 6/2007 | Morita et al. | 345/63 |
| 7,907,137 | B2 * | 3/2011 | Shirasaki et al. | 345/212 |
| 7,921,159 | B1 * | 4/2011 | Cooley | 709/206 |
| 7,944,414 | B2 * | 5/2011 | Shirasaki et al. | 345/77 |
| 8,581,805 | B2 * | 11/2013 | Kimura et al. | 345/76 |

(Continued)

FOREIGN PATENT DOCUMENTS

| | | |
|---|---|---|
| JP | 2006-251322 | 9/2006 |
| JP | 2008-083272 | 4/2008 |

*Primary Examiner* — Prabodh M Dharia
(74) *Attorney, Agent, or Firm* — K&L Gates LLP

(57) ABSTRACT

A display device includes: a display section including scan lines, power lines, signal lines, and pixels, each having a light emitting element and a pixel circuit which has a first transistor controlling a current in the light emitting element, and a second transistor writing a voltage on the signal line to the first transistor; and a driver section driving the pixels. Each power line is provided for each unit of pixel rows. The driver section sequentially applies a first pulse signal for inactivating the light emitting element to each of the scan lines in a pixel row unit, and applies one or more second pulse signals for activating the second transistor to at least a scan line corresponding to a pixel row to be inactivated first in the pixel row unit while a non-gray-scale signal is applied to each signal line.

8 Claims, 14 Drawing Sheets

(56) References Cited

U.S. PATENT DOCUMENTS

| | | | | |
|---|---|---|---|---|
| 2002/0057266 | A1* | 5/2002 | Miyajima | 345/204 |
| 2002/0135595 | A1* | 9/2002 | Morita et al. | 345/589 |
| 2005/0285830 | A1* | 12/2005 | Iwabuchi | 345/77 |
| 2006/0007212 | A1* | 1/2006 | Kimura et al. | 345/204 |
| 2006/0197458 | A1* | 9/2006 | Winters et al. | 315/169.1 |
| 2006/0267886 | A1* | 11/2006 | Ozaki et al. | 345/76 |
| 2007/0139437 | A1* | 6/2007 | Boroson et al. | 345/590 |
| 2007/0200803 | A1* | 8/2007 | Kimura | 345/76 |
| 2008/0030437 | A1* | 2/2008 | Iida et al. | 345/80 |
| 2008/0049007 | A1* | 2/2008 | Iida et al. | 345/211 |
| 2008/0150843 | A1* | 6/2008 | Yamamoto et al. | 345/76 |
| 2008/0231625 | A1* | 9/2008 | Minami et al. | 345/212 |
| 2008/0238830 | A1* | 10/2008 | Iida et al. | 345/76 |
| 2010/0053233 | A1* | 3/2010 | Ishiguro et al. | 345/690 |
| 2010/0188384 | A1* | 7/2010 | Uchino et al. | 345/211 |
| 2010/0259533 | A1* | 10/2010 | Yamashita et al. | 345/213 |
| 2011/0102413 | A1* | 5/2011 | Hamer et al. | 345/213 |
| 2013/0293601 | A1* | 11/2013 | Akimoto et al. | 345/691 |

* cited by examiner

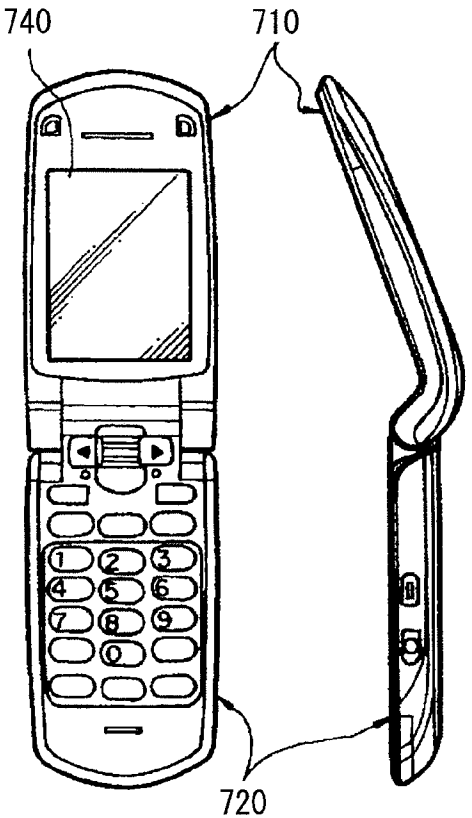
FIG. 14A
FIG. 14B
FIG. 14D
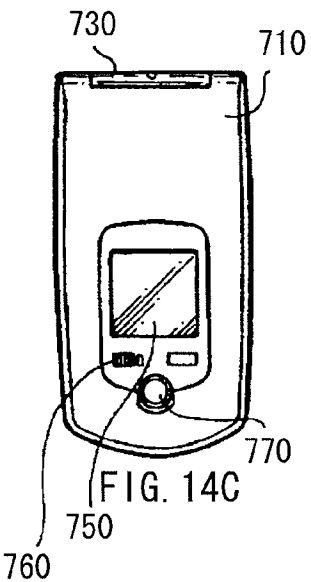
FIG. 14C
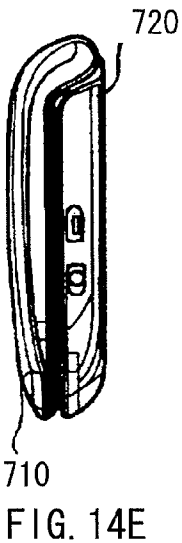
FIG. 14E
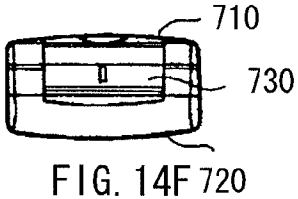
FIG. 14F
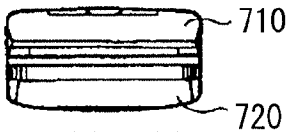
FIG. 14G

DISPLAY DEVICE, METHOD OF DRIVING THE DISPLAY DEVICE, AND ELECTRONIC DEVICE

CROSS REFERENCES TO RELATED APPLICATIONS

The present application claims priority to Japanese Priority Patent Application JP 2010-016888 filed in the Japan Patent Office on Jan. 28, 2010, the entire content of which is hereby incorporated by reference.

BACKGROUND

The present application relates to a display device displaying images by using a light emitting element disposed for each pixel, and a method of driving the display device. Furthermore, the application relates to an electronic device having the display device.

Recently, in a field of display devices for image display, a display device using a current-drive optical element as a light emitting element of a pixel, the optical element being changed in luminance in accordance with a value of electric current flowing into the optical element, for example, a display device using organic EL (Electro Luminescence) elements has been developed and is being commercialized. The organic EL element is a self-luminous element unlike a liquid crystal element or the like. Therefore, the display device using organic EL elements (organic EL display device) does not need a light source (backlight), and therefore is high in image visibility, low in power consumption, and high in response speed of an element compared with a liquid crystal display that needs a light source.

A drive method of the organic EL display device includes simple (passive) matrix drive and active matrix drive as in the liquid crystal display. The simple matrix drive may simplify a device structure, but hardly increases display size and resolution. Therefore, the active matrix drive is being actively developed at present. In the active matrix drive, electric current flowing into a light emitting element disposed for each pixel is controlled by a driver transistor.

Generally, threshold voltage $V_{th}$ or mobility v, of a driver transistor may be temporally varied, or may be different for each of pixels due to variation in a manufacturing process. When the threshold voltage $V_{th}$ or the mobility v, is different for each pixel, a value of current flowing into the driver transistor varies for each pixel, and therefore even if the same voltage is applied to gates of driver transistors, luminance of an organic EL element varies for each pixel, leading to reduction in uniformity of a screen. Thus, a display device has been developed, which includes a function of correcting variation in threshold voltage $V_{th}$ or mobility μ, (for example, see Japanese Unexamined Patent Application Publication No. 2008-083272).

In the active-matrix display device, any of a signal line driver circuit, which drives signal lines, a write line driver circuit, which sequentially selects a pixel, and a power line driver circuit, which supplies power to each pixel, is basically configured of a shift register (not shown), and has a signal output section (not shown) for each stage in correspondence to each pixel column or each pixel row. Therefore, when the number of pixel columns and the number of pixel rows are increased, the number of signal lines and the number of gate lines are accordingly increased, and the number of output stages of a shift register is correspondingly increased, leading to increase in size of a peripheral circuit of a display device.

Thus, a measure of sharing an output stage of a shift register has been taken in the past in order to reduce size of a peripheral circuit. For example, Japanese Unexamined Patent Application Publication No. 2006-251322 proposes a method where a signal line is shared by a plurality of pixels. According to this, each output stage of a shift register in the signal line driver circuit may be shared by a plurality of pixel columns, and a circuit scale, circuit area, and circuit cost may be correspondingly reduced

SUMMARY

Japanese Unexamined Patent Application Publication No. 2006-251322 describes that an output stage of a shift register in a signal line driver circuit is shared by a plurality of pixel columns. Even in a write line driver circuit or a power line driver circuit, an output stage of a shift register is importantly shared in order to improve cost performance of a display device. In particular, in the power line driver circuit, since size of a signal output section needs to be large to stabilize current supply capability, each output stage of a shift register in the power line driver circuit is shared by a plurality of pixel rows so as to reduce the number of signal output sections, thereby cost and size of a display device may be effectively reduced.

FIG. 15 shows a schematic configuration of a display device, in which each signal output section in a power line driver circuit is shared by a plurality of pixel rows. In a display device 100 of FIG. 15, power lines PSL (PSL1, PSL2,•••••) are individually connected to each signal output section in a power line driver circuit 140, and pixels 111 in a plurality of pixel rows (three rows in FIG. 15) are connected to each of the power lines PSL (PSL1, PSL2,•••••). Signal lines DTL (DTL1, DTL2,•••••) are individually connected to each of signal output sections in a signal line driver circuit 120, and pixels 111 in each row are individually connected to each of the signal lines DTL (DTL1, DTL2,•••••). Write lines WSL (WSL1, WSL2,•••••) are individually connected to each signal output section in a write line driver circuit 130, and pixels 111 in each column are individually connected to each of the write lines WSL (WSL1, WSL2,•••••).

FIGS. 16 and 17 show an example of various waveforms in the display device 100 of FIG. 15. (A) and (E) of FIG. 16 show an aspect where two kinds of voltages ($V_{cc}$ and $V_{ss}$ ($<V_{cc}$)) are applied to the power lines PSL1 and PSL2. (B) to (D) and (F) to (H) of FIG. 16 show an aspect where three kinds of voltages ($V_{on}$, $V_{off1}$ ($<V_{on}$) and $V_{off2}$ ($<V_{off1}$)) are applied to the write lines WSL1 to WSL6. (A) of FIG. 17 shows an aspect where two kinds of voltages ($V_{cc}$ and $V_{ss}$) are applied to the power line PSL1. (B) to (D) of FIG. 17 show an aspect where three kinds of voltages ($V_{on}$, $V_{off}$ and $V_{off2}$) are applied to the write lines WSL1 to WSL3. (E) and (F) of FIG. 17 show an aspect where gate voltage $V_g$ and source voltage $V_s$ of the driver transistor $Tr_1$ change every moment in correspondence to voltage application to the power line PSL1, the write lines WSL1 to WSL3, and the signal line DTL. In (E) and (F) of FIG. 17, gate voltage corresponding to the write line WSL1 is denoted by $V_{g1}$, and gate voltage corresponding to the write line WSL3 is denoted by $V_{g3}$. As understood from FIG. 16, in the display device 100, unit scan is performed, where $V_{cc}$ or $V_{ss}$ is applied at a common timing from each of the power lines PSL (PSL1, PSL2,•••••) to pixels 111 in each of units with a plurality of pixel rows (three rows in FIG. 16) as a unit.

As shown in FIGS. 16 and 17, time (waiting time) from time $T_1$ when non-emission operation is started to time $T_2$ when voltage of the power line PSL lowers from $V_{cc}$ to $V_{ss}$ is different for each of lines in one unit. For example, when one unit has 30 lines, a difference in waiting time between a first line and a 30th line is 29H. Source voltage $V_s$ gradually lowers during the waiting time, for example, as shown in (F) of FIG. 17, which slowly proceeds due to a capacitive component of an organic EL element 111R and the like, and therefore a slight current flows in the pixel circuit from the time $T_1$ to the time $T_2$. As a result, when one unit has an excessively large number of lines, luminance of the first line is increased from luminance of the final line in a period from the time $T_1$ to the time $T_2$, and consequently a stripe pattern occurs between adjacent units.

Moreover, as source voltage $V_s$ gradually lowers to a predetermined potential in a period from the time $T_1$ to the time $T_2$, gate voltage $V_g$ also gradually lowers, for example, as shown in (E) and (F) of FIG. 17. Since decrease in gate voltage $V_g$ correlates to decrease in source voltage $V_s$, decrease in each of the source voltage $V_s$ and the gate voltage $V_g$ is large in a first line compared with in a final line in one unit. Thus, a difference occurs in each of the source and gate voltages between the first and final lines ($\Delta V_s$ and $\Delta V_g$ in the figure) immediately before time $T_3$ when voltage of the power line PSL rises from $V_{ss}$ to $V_{cc}$. Then, when voltage of the power line PSL rises from $V_{ss}$ to $V_{cc}$ ($T_3$), gate voltages $V_g$ become substantially the same between all lines in one unit. However, the difference ($\Delta V_s$) in source voltage $V_s$ remains between the first and final lines. Since the difference in source voltage $V_s$ ($\Delta V_s$) remains through light emission, luminance is different for each of lines in light emission, leading to occurrence of a stripe pattern between adjacent units.

In this way, a stripe pattern has disadvantageously occurred between adjacent units due to difference in waiting time for each of lines in the past.

It is desirable to provide a display device, in which occurrence of a stripe pattern may be prevented in unit scan, a method of driving the display device, and an electronic device having the display device.

A display device according to an embodiment has a display section including a plurality of scan lines and a plurality of power lines, being arranged in rows, a plurality of signal lines arranged in columns, and a plurality of pixels arranged in a matrix, and further has a driver section driving each pixel. Each pixel has a light emitting element and a pixel circuit. The pixel circuit has a first transistor controlling a current flowing into the light emitting element, and a second transistor writing a voltage of a signal line to the first transistor. The plurality of power lines are individually provided for each of units with a plurality of pixel rows as a unit. The driver section sequentially applies one, first pulse signal for stopping light emission of the light emitting element to a plurality of scan lines in each unit, and applies one or more, second pulse signal for turning the second transistor on to at least scan line corresponding to a pixel row, being first stopped in light emission, among a plurality of pixel rows in each unit while a non-gray-scale signal is applied to each signal line.

An electronic device according to an embodiment includes the above-described display device.

A method of driving a display device according to an embodiment performs the following step in a display device having a configuration described below: one, first pulse signal for stopping light emission of a light emitting element is sequentially applied to a plurality of scan lines in each unit, and one or more, second pulse signal for turning a second transistor on is applied to a scan line corresponding to at least a pixel row, being first stopped in light emission, among a plurality of pixel rows in each unit while a non-gray-scale signal is applied to each signal line.

The display device using the above-described drive method has a display section including a plurality of scan lines and a plurality of power lines, being arranged in rows, a plurality of signal lines arranged in columns, and a plurality of pixels arranged in a matrix, and further has a driver section driving each pixel. Each pixel has a light emitting element and a pixel circuit. The pixel circuit has a first transistor controlling a current flowing into the light emitting element, and a second transistor writing a voltage of a signal line to the first transistor. The plurality of power lines are individually provided for each of units with a plurality of pixel rows as a unit.

In the display device, the method of driving the display device, and the electronic device according to the embodiment, one, first pulse signal for stopping light emission of the light emitting element is sequentially applied to a plurality of scan lines in each unit. Thus, a plurality of light emitting elements are sequentially stopped in light emission for each row. Furthermore, one or more, second pulse signal for turning the second transistor on is applied to a scan line corresponding to at least a pixel row, being first stopped in light emission, among a plurality of pixel rows in each unit while a non-gray-scale signal is applied to each signal line. Thus, a difference in source voltage of the first transistor in each unit may be reduced compared with previous cases where the second pulse signal is not applied after stop of light emission.

According to the display device, the method of driving the display device, and the electronic device of the embodiment, the second pulse signal is applied after stop of light emission, thereby a difference in source voltage of the first transistor in each unit may be reduced compared with in the past. Thus, occurrence of a stripe pattern between adjacent units may be prevented in unit scan.

Additional features and advantages are described herein, and will be apparent from the following Detailed Description and the figures.

BRIEF DESCRIPTION OF THE FIGURES

FIG. 11A shows appearance of application example 2 as viewed from a surface side, and FIG. 11B shows appearance thereof as viewed from a back side.

FIGS. 14A to 14G are diagrams of application example 5, where FIG. 14A is a front diagram of the application example 5 in an opened state, FIG. 14B is a side diagram thereof, FIG. 14C is a front diagram thereof in a closed state, FIG. 14D is a left side diagram thereof, FIG. 14E is a right side diagram thereof, FIG. 14F is a top diagram thereof, and FIG. 14G is a bottom diagram thereof.

DETAILED DESCRIPTION

Embodiments of the present application will be described below in detail with reference to the drawings.

Figure 15:
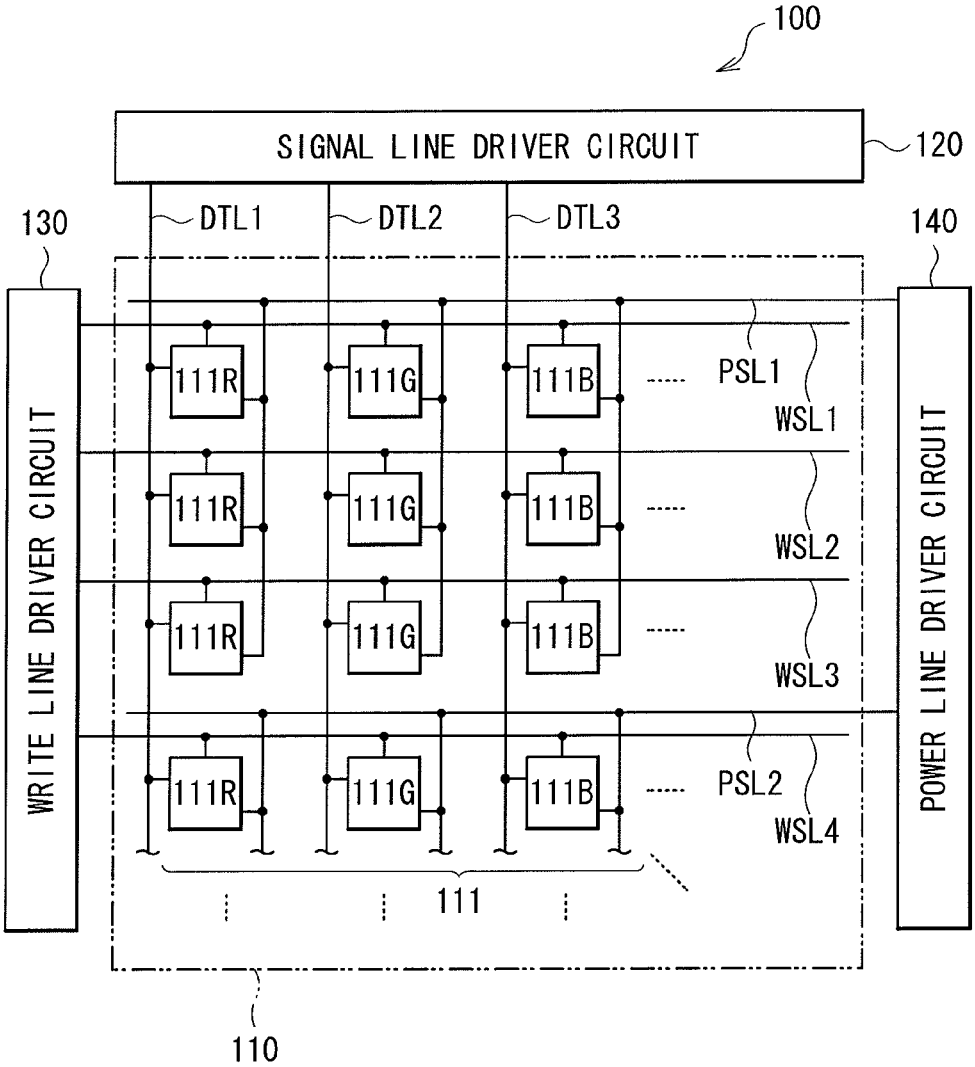
FIG. 15 RELATED ART
FIG. 15 is a block diagram showing an example of a display device in related art.
Figure 16:
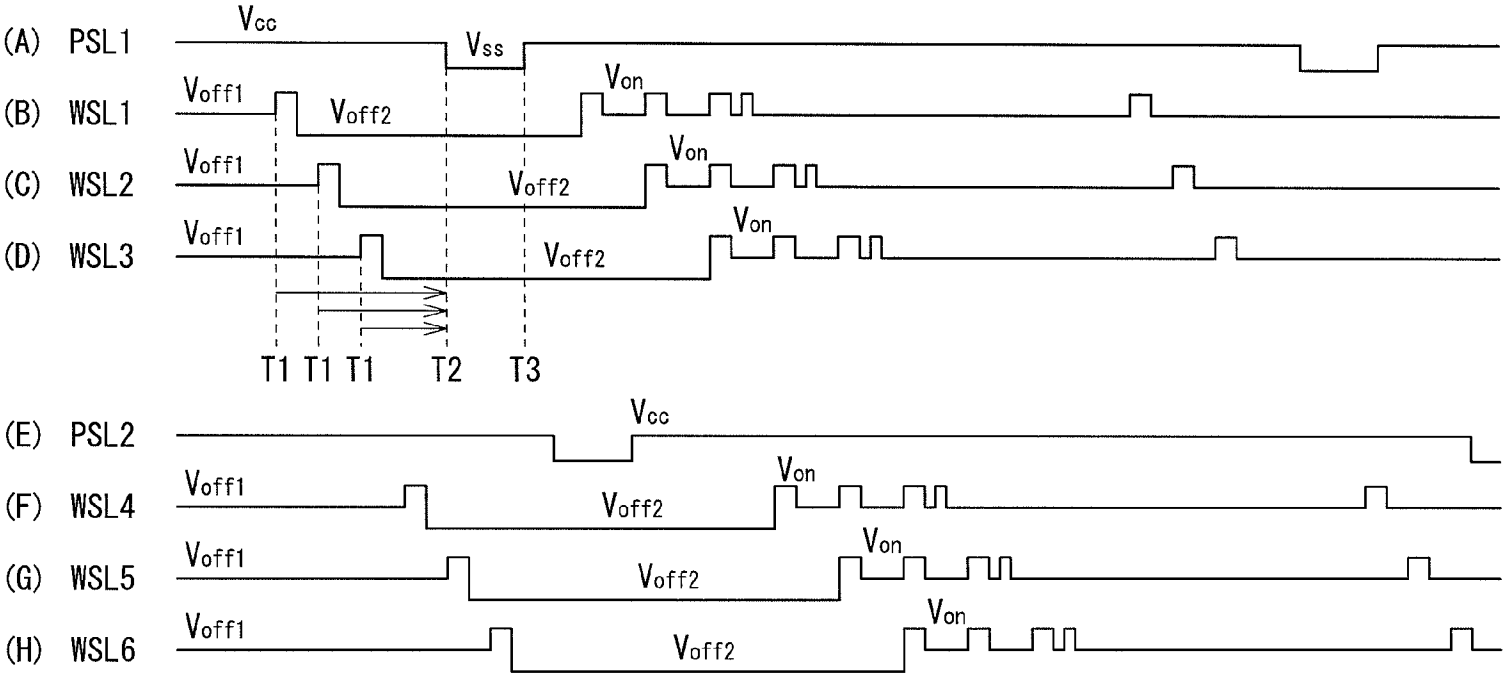
FIG. 16 RELATED ART
FIG. 16 is a waveform diagram for illustrating an example of operation of the display device of FIG. 15.
Figure 17:
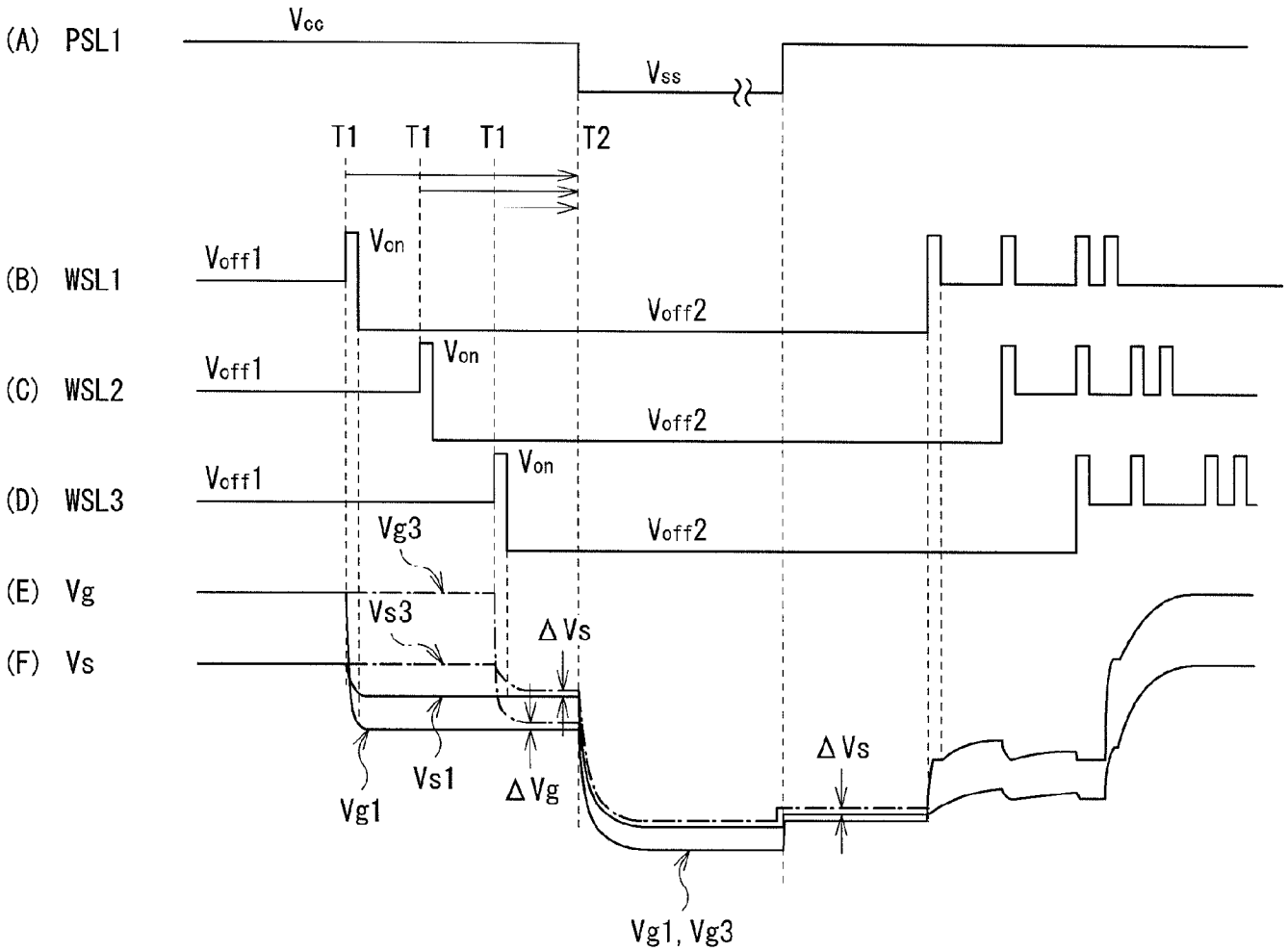
FIG. 17 RELATED ART
FIG. 17 is a waveform diagram for illustrating an example of operation in one unit of the display device of FIG. 15.

1. Embodiment (FIGS. 1 to 6)
2. Modifications (FIGS. 7 and 8)
3. Module and application examples (FIGS. 9 to 14G)
4. Previous example (FIGS. 15 to 17)

Figure 1:
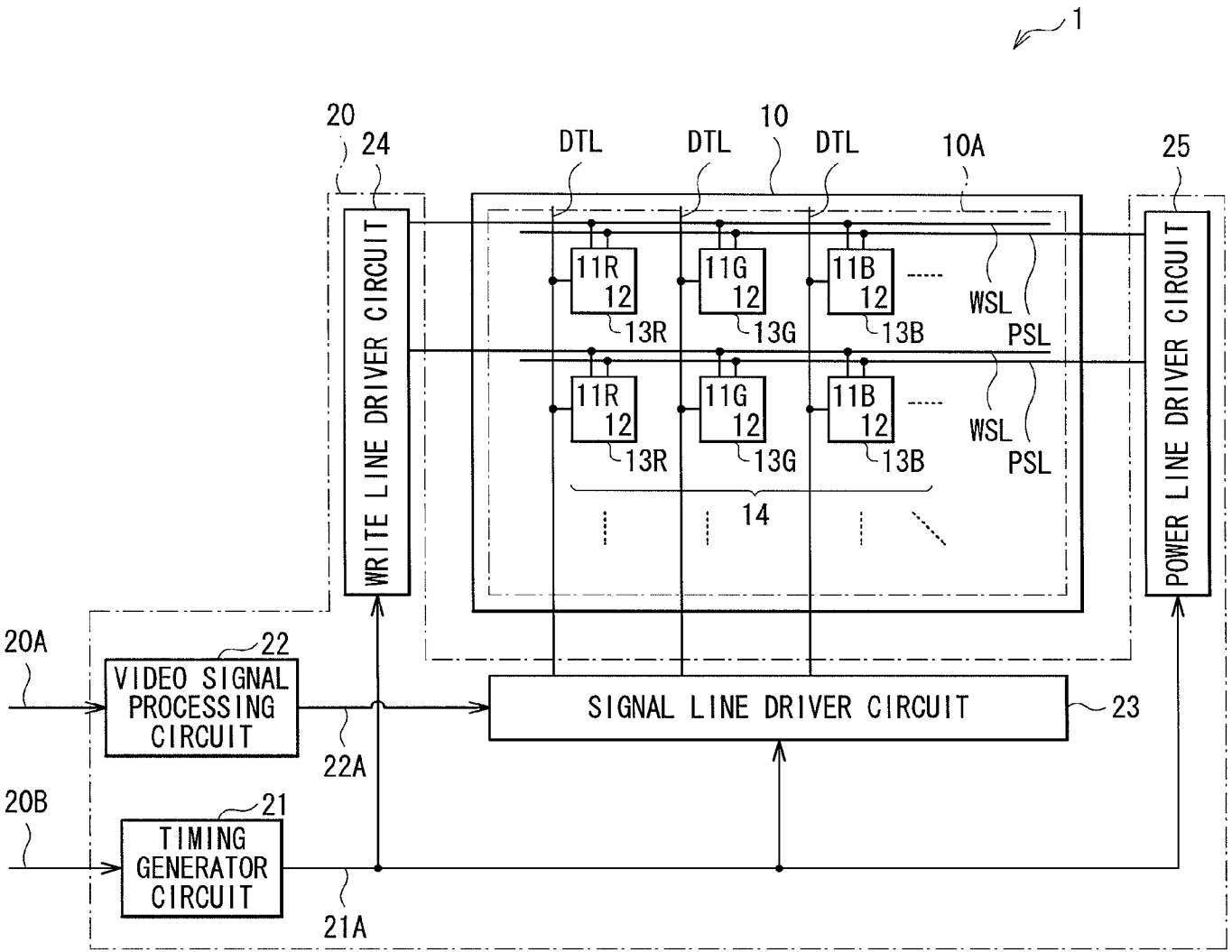
FIG. 1 is a block diagram showing an example of a display device according to an embodiment.

FIG. 1 shows an example of a general configuration of a display device 1 according to an embodiment. The display device 1 has, for example, a display panel 10 (display section) and a driver circuit 20 (driver section).

Display Panel 10

The display panel 10 has a display region 10A, in which three kinds of organic EL elements 11R, 11G and 11B (light emitting elements) having different emission colors from one another are two-dimensionally arranged. The display region 10A is a region for displaying video pictures by using light emitted from the organic EL elements 11R, 11G and 11B. The organic EL element 11R emits red light, the organic EL element 11G emits green light, and the organic EL element 11B emits blue light. Hereinafter, a term, organic EL element 11, is appropriately used as a general term of the organic EL elements 11R, 11G and 11B.

Display Region 10A

Figure 2:
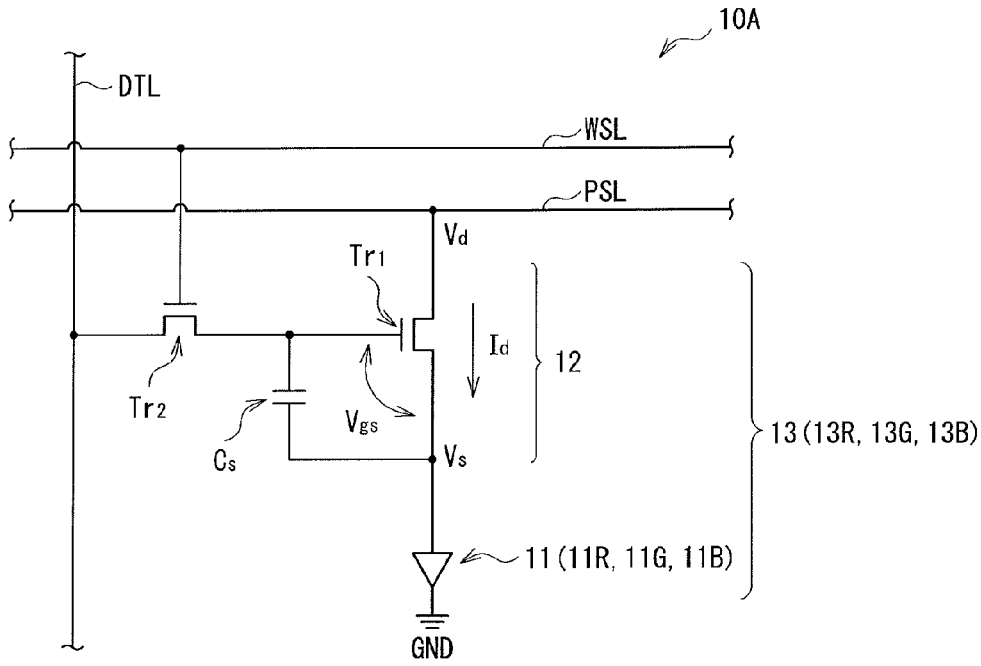
FIG. 2 is a block diagram showing an example of an internal configuration of a pixel in FIG. 1.

FIG. 2 shows an example of a circuit configuration in the display region 10A. In the display region 10A, a plurality of pixel circuits 12 are two-dimensionally arranged while being individually coupled with organic EL elements 11. In the embodiment, an organic EL element 11 is coupled with a pixel circuit 12 to configure one pixel 13. Specifically, as shown in FIG. 1, an organic EL element 11R is coupled with a pixel circuit 12 to configure one pixel 13R (red pixel), an organic EL element 11G is coupled with a pixel circuit 12 to configure one pixel 13G (green pixel), and an organic EL element 11B is coupled with a pixel circuit 12 to configure one pixel 13B (blue pixel). Furthermore, three pixels 13R, 13G and 13B adjacent to one another configure one display pixel 14.

Each pixel circuit 12 is configured of, for example, a driver transistor $Tr_1$ (first transistor) controlling a current flowing into the organic EL element 11, a write transistor $Tr_2$ (second transistor) writing voltage of a signal line DTL into the driver transistor $Tr_1$, and a capacitance $C_s$, namely, the pixel circuit has a circuit configuration of 2Tr1C. The driver transistor $Tr_1$ and the write transistor $Tr_2$ are, for example, formed of an n-channel MOS thin-film transistor (TFT), respectively. The driver transistor $Tr_1$ or the write transistor $Tr_2$ may be, for example, a p-channel MOS TFT.

In the display region 10A, a plurality of write lines WSL (scan lines) are arranged in rows, and a plurality of signal lines DTL are arranged in columns. Furthermore, a plurality of power lines PSL (members supplied with source voltage) are arranged in rows along the write lines WSL in the display region 10A. The organic EL elements 11 are individually provided near intersections between the signal lines DTL and the scan lines WSL. Each signal line DTL is connected to an output end (not shown) of a signal line driver circuit 23 described later and one of drain and source electrodes (not shown) of the write transistor $Tr_2$. Each scan line WSL is connected to an output end (not shown) of a write line driver circuit 24 described later and a gate electrode (not shown) of the write transistor $Tr_2$. Each power line PSL is connected to an output end (not shown) of a power line driver circuit 25 described later and to one of drain and source electrodes (not shown) of the driver transistor Tn. The other of the drain and source electrodes (not shown), being not connected to the signal line DTL, of the write transistor $Tr_2$ is connected to a gate electrode (not shown) of the driver transistor $Tr_1$ and one end of the capacitance $C_s$. The other of the drain and source electrodes (not shown), being not connected to the power line PSL, of the driver transistor $Tr_1$ and the other end of the capacitance $C_s$ are connected to an anode electrode (not shown) of the organic EL element 11. A cathode electrode (not shown) of the organic EL element 11 is connected to, for example, a ground line GND.

Figure 3:
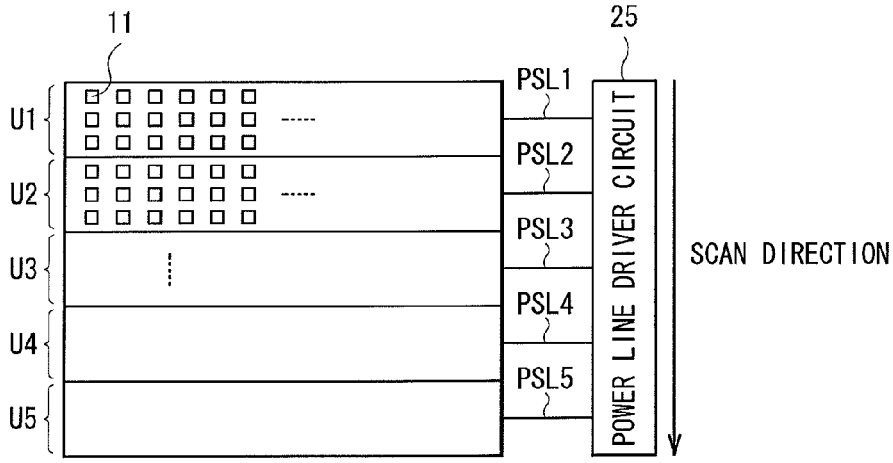
FIG. 3 is a conceptual diagram for illustrating unit scan in the display device of FIG. 1.

As shown in FIGS. 1 and 3, the power lines PSL are individually provided for each of units U with a plurality of pixel rows as a unit. While FIG. 3 illustrates a case where five units U are provided, the number of units is not limited to five. In FIG. 3, five units U are attached with suffixes increasing one by one in a scanning direction of the power line driver circuit 25. Therefore, unit Ul corresponds to a first unit in the scan direction, and unit U5 corresponds to a final unit in the scan direction.

Driver Circuit 20

Next, circuits in the driver circuit 20 are described with reference to FIG. 1. The driver circuit 20 has a timing generator circuit 21, a video signal processing circuit 22, the signal line driver circuit 23, the write line driver circuit 24, and the power line driver circuit 25.

The timing generator circuit 21 controls the video signal processing circuit 22, the signal line driver circuit 23, the write line driver circuit 24, and the power line driver circuit 25 such that the circuits operate in conjunction with one another. For example, the timing generator circuit 21 outputs a control signal 21A to each of the circuits in response to (in synchronization with) a synchronizing signal 20B received from the outside.

The video signal processing circuit 22 applies predetermined correction to a video signal 20A received from the outside, and outputs a corrected video signal 22A to the signal line driver circuit 23. Such predetermined correction includes, for example, gamma correction and overdrive correction.

The signal line driver circuit 23 applies the video signal 22A (signal voltage $V_{sig}$) received from the video signal processing circuit 22 to each signal line DTL in response to (in synchronization with) input of the control signal 21A to perform writing of the video signal into a pixel 13 as a selection object. Writing means application of a predetermined voltage to the gate of the driver transistor Tn.

The signal line driver circuit 23 is, for example, configured of a shift resistor (not shown), having a signal output section (not shown) for each stage in correspondence to each column of the pixels 13. The signal line driver circuit 23 may output three kinds of voltages ($V_{sig}$, $V_{ofs}$ and $V_{ers}$) to each signal line DTL in response to (in synchronization with) input of the control signal 21A. Specifically, the signal line driver circuit 23 sequentially supplies the three kinds of voltages ($V_{sig}$, $V_{ofs}$ and $V_{ers}$) to a pixel 13 selected by the write line driver circuit 24 via a signal line DTL connected to each pixel 13.

Here, the voltage $V_{sig}$ has a value corresponding to the video signal 22A. A lowest value of $V_{sig}$ is lower than a value of $V_{ofs}$, and a highest value of $V_{sig}$ is higher than a value of $V_{ofs}$. $V_{ofs}$ is a non-gray-scale signal independent of the video signal 22A, and has a value (fixed value) lower than a value of $V_{ers}$. The voltage $V_{ers}$ has a value (fixed value) lower than a threshold voltage $V_{el}$ of the organic EL element 11.

The write line driver circuit 24 is, for example, configured of a shift resistor (not shown), and has a signal output section (not shown) for each stage in correspondence to each row of the pixels 13. The write line driver circuit 24 may output three kinds of voltages ($V_{on}$, $V_{off1}$ and $V_{off2}$) to each write line WSL in response to (in synchronization with) input of the control signal 21A. Specifically, the write line driver circuit 24 supplies the three kinds of voltages ($V_{on}$, $V_{off1}$ and $V_{off2}$) to a pixel 13 as a driving object via a write line WSL connected to each pixel 13 so as to control the write transistor $Tr_2$.

Here, the voltage $V_{on}$ has a value higher than on voltage of the write transistor $Tr_2$. The voltage $V_{on}$ is outputted from the write line driver circuit 24 when non-emission operation or threshold correction described later is performed. Each of $V_{off1}$ and $V_{off2}$ has a value lower than a value of on voltage of the write transistor $Tr_2$. $V_{off2}$ has a value lower than a value of $V_{off1}$.

The power line driver circuit 25 is, for example, configured of a shift resistor (not shown), and has signal output sections (not shown) for stages, being the same in number as rows in each of units (U1 to U5), in correspondence to each of the units (U1 to U5). That is, in the embodiment, each output stage of the shift register in the power line driver circuit 25 is shared for each of the units (U1 to U5), namely, unit scan is performed. Therefore, the number of signal output sections in the power line driver circuit 25 is small compared with a case where a signal output section is provided for each stage in correspondence to each pixel column.

The power line driver circuit 25 may output two kinds of voltages ($V_{ss}$ and $V_{cc}$) in response to (in synchronization with) input of the control signal 21A. Specifically, the power line driver circuit 25 supplies the two kinds of voltages ($V_{ss}$ and $V_{cc}$) to a pixel 13 as a driving object via a power line PSL connected to each pixel 13 so as to control emission operation and non-emission operation of the organic EL element 11.

Here, $V_{ss}$ has a value lower than a value of voltage ($V_{el}$+$V_{ca}$) as the sum of the threshold value $V_{el}$ of the organic EL element 11 and a cathode voltage $V_{ca}$ thereof. The voltage $V_{cc}$ has a value equal to or higher than the value of the voltage ($V_{el}$+$V_{ca}$).

Next, an example of operation (non-emission operation to emission operation) of the display device 1 of the embodiment will be described. In the embodiment, the display device has a function of correcting variation in threshold voltage $V_{th}$ or mobility v, of the driver transistor $Tr_1$ so that even if the threshold voltage $V_{th}$ or the mobility μ, is temporally changed, luminance of the organic EL element 11 is not affected by such a change, and is thus kept constant.

Figure 4:
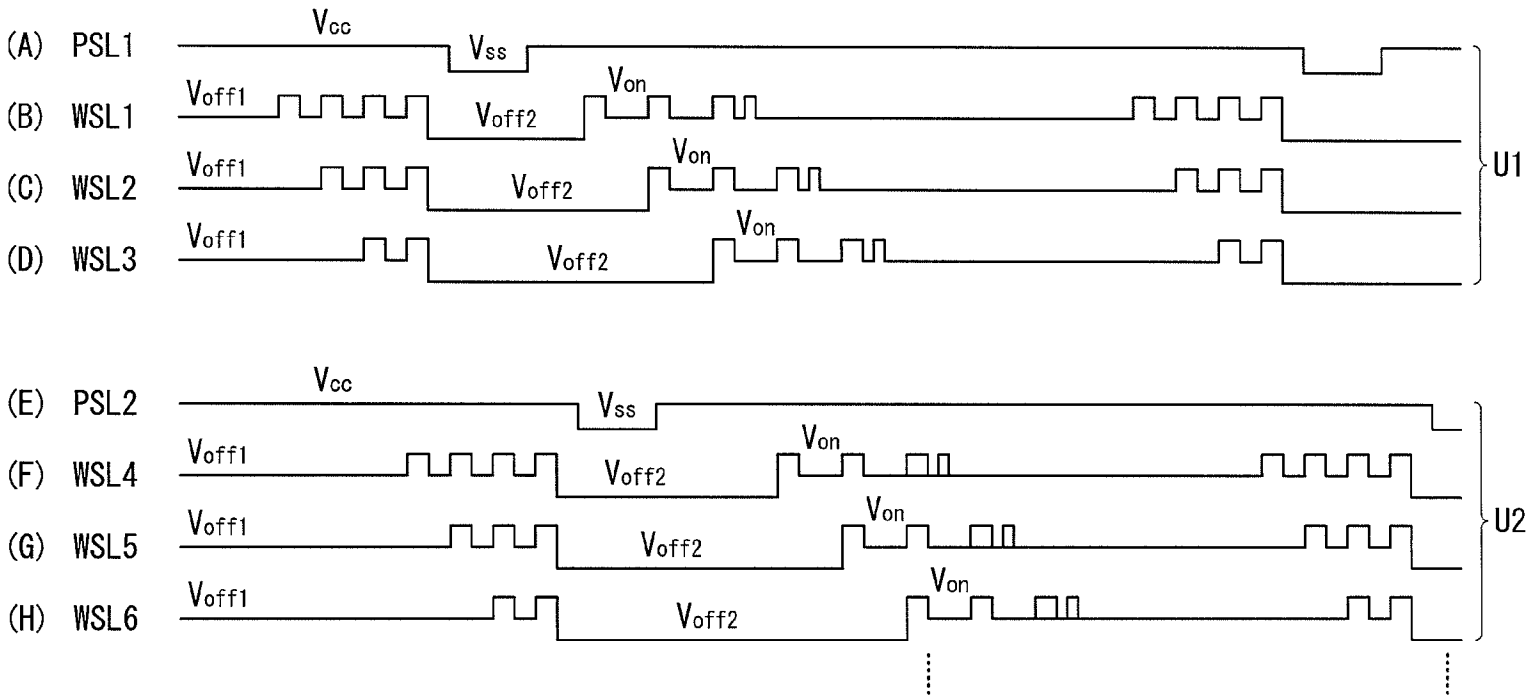
FIG. 4 is a waveform diagram for illustrating an example of operation of the display device of FIG. 1.

FIG. 4 shows an example of various waveforms in the display device 1. FIG. 4 shows an aspect where two kinds of voltages ($V_{ss}$ and $V_{cc}$) are applied to power lines PSL, and three kinds of voltages ($V_{on}$, $V_{off1}$ and $V_{off2}$) are applied to write lines WSL1 to WSL6. As understood from FIGS. 1 and 4, in the display device 1, $V_{ss}$ and $V_{cc}$ are applied from power lines PSL (PSL1, PSL2,••••) to pixels 13 for each of units (U1 to U5) at a common timing.

Figure 5:
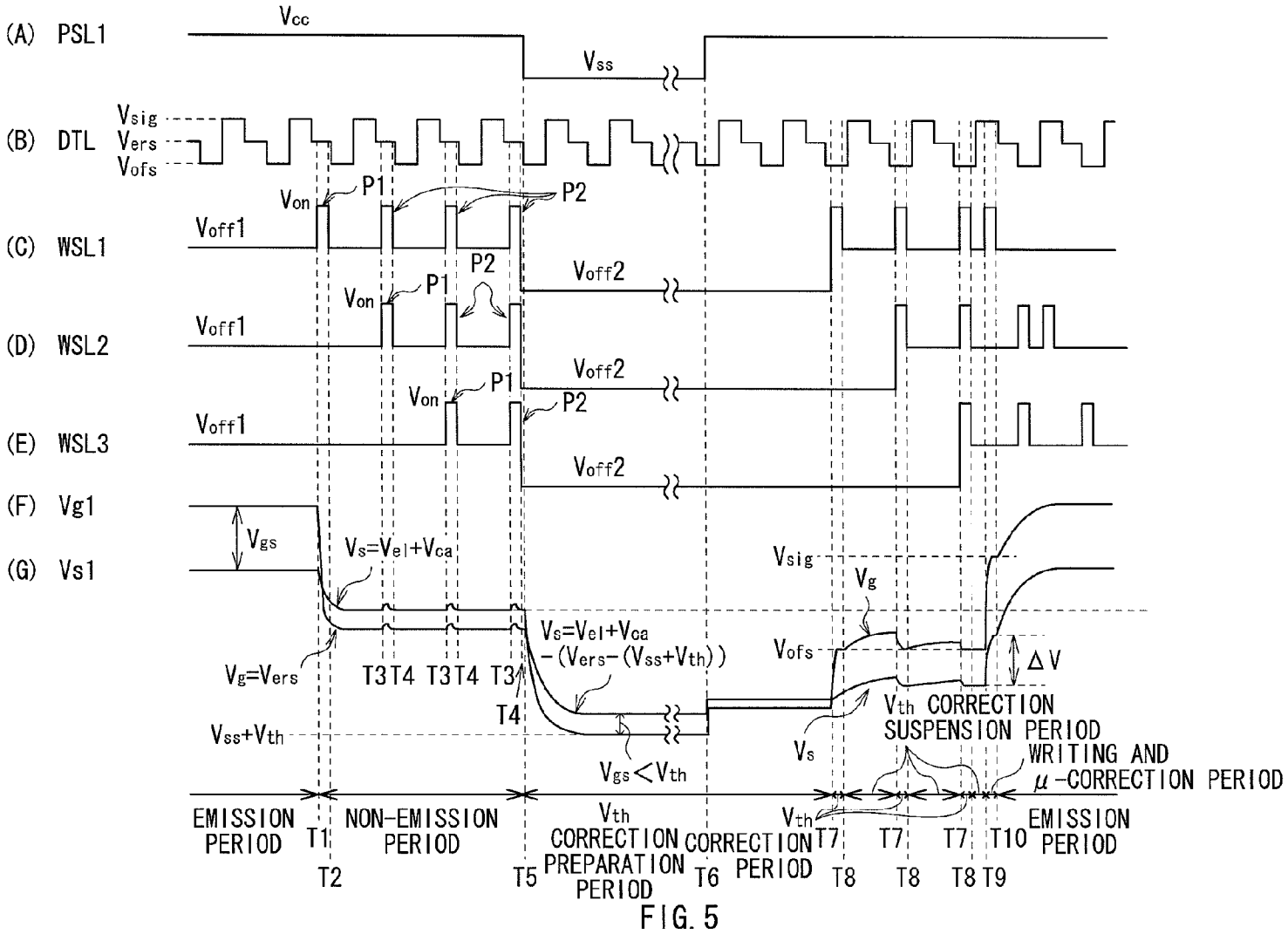
FIG. 5 is a waveform diagram for illustrating an example of operation in one unit.

FIG. 5 shows an example of voltage waveforms applied to one unit U of the display device 1. Specifically, FIG. 5 shows an aspect where two kinds of voltages ($V_{ss}$ and $V_{cc}$) are applied to a power line PSL, three kinds of voltages ($V_{sig}$, $V_{ers}$ and $V_{ofs}$) are applied to a signal line DTL, and three kinds of voltages ($V_{on}$, $V_{off1}$ and $V_{off2}$) are applied to write lines WSL. Furthermore, (F) and (G) of FIG. 5 show an aspect where gate voltage $V_{g1}$ and source voltage $V_{s1}$ of the driver transistor $Tr_1$ change every moment in correspondence to voltage application to a power line PSL1, the signal line DTL, and a write line WSL1. The gate voltage $V_{g1}$ is a gate voltage of a line (pixel row) corresponding to the write line WSL1, and the source voltage $V_{s1}$ is a source voltage of the line (pixel row) corresponding to the write line WSL1.

Non-Emission Period

First, light emission of the organic EL element 11 is stopped. Specifically, when voltage of the power line PSL1 is $V_{cc}$, and voltage of the signal line DTL is $V_{ers}$, the write line driver circuit 24 sequentially applies one emission-stop pulse signal (first pulse signal P1) having a crest value $V_{on}$ to the write lines WSL1 to WSL3. Specifically, the write line driver circuit 24 raises voltages of the write lines WSL1 to WSL3 from $V_{off1}$ to $V_{on}$ ($T_1$), so that the gate of the driver transistor $Tr_1$ is connected to the signal line DTL. Thus, the gate voltage $V_{g1}$ of the driver transistor $Tr_1$ begins to lower, and the source voltage $V_{s1}$ of the driver transistor $Tr_1$ also begins to lower through coupling via the capacitance $C_s$. Then, when the gate voltage $V_{g1}$ reaches $V_{ers}$, and the source voltage $V_{s1}$ reaches $V_{el}$+$V_{ca}$ ($V_{ca}$ is cathode voltage of the organic EL element 11), and light emission of the organic EL element 11 is thus stopped, the write line driver circuit 24 sequentially lowers voltages of the write lines WSL1 to WSL3 from $V_{on}$ to $V_{off1}$ so that the gate of the driver transistor $Tr_1$ becomes floating ($T_2$).

Next, when voltage of the power line PSL1 is $V_{cc}$ and voltage of the signal line DTL is $V_{ers}$, and immediately before voltage of the power line PSL1 changes from $V_{cc}$ to $V_{ss}$, the write line driver circuit 24 applies one or more emission-stop pulse signals (second pulse signal P2) having a crest value $V_{on}$ to the write lines WSL1 to WSL3. Specifically, the write line driver circuit 24 raises voltages of the write lines WSL1 to WSL3 from $V_{off1}$ to $V_{on}$ ($T_3$) at a predetermined timing (for example, every 1H), so that the gate of the driver transistor $Tr_1$ is connected to the signal line DTL, and then when a predetermined period has passed, the write line driver circuit 24 lowers voltages of the write lines WSL1 to WSL3 from $V_{on}$ to $V_{off1}$ (or $V_{off2}$). Thus, the gate voltage $V_{g1}$ and the source voltage $V_{s1}$ of the driver transistor $Tr_1$ slightly raise and then gradually lower.

Figure 6:
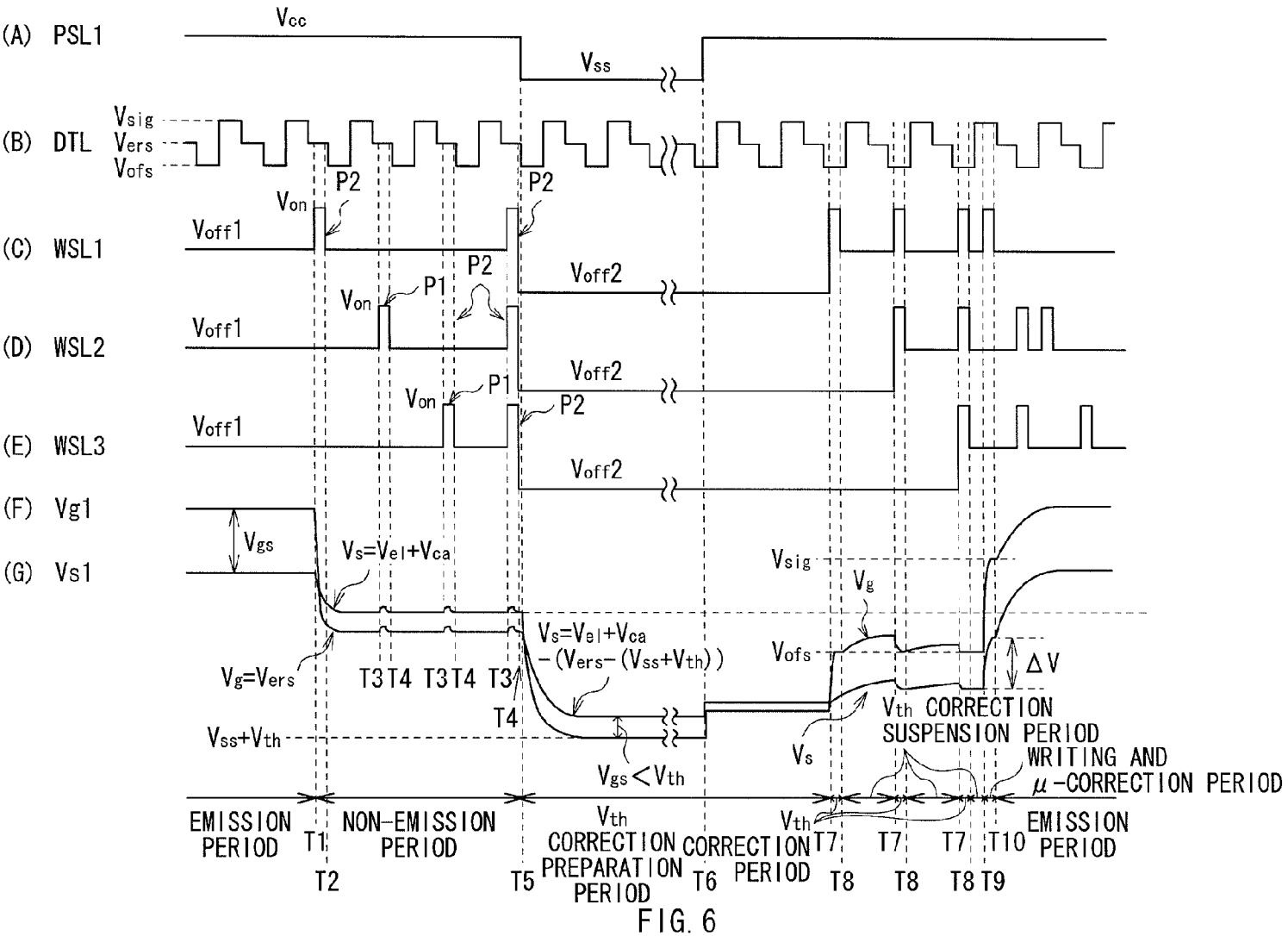
FIG. 6 is a waveform diagram for illustrating another example of operation in one unit.

The number of times of applying the second pulse signal P2 to the write lines WSL1 to WSL3 may be different from one another between the write lines WSL1 to WSL 3 (FIG. 5), or may be equal to one another (FIG. 6). Alternatively, the number of times of applying the second pulse signal P2 to the write lines WSL1 to WSL3 may decrease in a scanning direction of the write line driver circuit 24, for example, as shown in FIG. 5. For example, the number may decrease one by one in the scanning direction of the write line driver circuit 24.

The crest value of the first pulse signal P1 and the crest value of the second pulse signal P2 may be equal to each other (FIGS. 5 and 6), or may be different from each other. In addition, pulse width of the first pulse signal P1 and pulse width of the second pulse signal P2 may be equal to each other (FIGS. 5 and 6), or may be different from each other. In the non-emission period, the first pulse signal P1 or the second pulse signal P2 may be applied at the same timing between all write lines WSL except for a write line WSL, being not applied with the first pulse signal P1, among the plurality of write lines WSL1 to WSL3 (FIGS. 5 and 6), or may not be applied at the same timing. A second pulse signal P2 is preferably finally applied to each of the write lines WSL1 to WSL3 at the same timing (FIGS. 5 and 6).

Threshold Correction Preparation Period

Next, preparation of threshold correction is performed. Specifically, when voltage of a write line WSL is $V_{off2}$, the power line driver circuit 25 lowers voltage of the power line PSL from $V_{cc}$ to $V_{ss}$ ($T_5$). Thus, a power line PSL side of the driver transistor $Tr_1$ turns into a source, so that current $I_d$ flows between the drain and the source of the driver transistor $Tr_1$, and when the gate voltage $V_{g1}$ reaches $V_{ss}+V_{th}$, the current $I_d$ stops. At that time, the source voltage $V_{s1}$ is $V_{el}+V_{ca}-(V_{ers}-(V_{ss}+V_{th}))$, and potential difference $V_{gs}$ is lower than $V_{th}$.

Next, the power line driver circuit 25 raises voltage of the power line PSL from $V_{ss}$ to $V_{cc}$ ($T_6$). Thus, current $I_d$ flows between the drain and the source of the driver transistor $Tr_1$, and the gate voltage $V_{g1}$ and the source voltage $V_{s1}$ rise due to capacitive coupling between gate-to-drain parasitic capacitance of the driver transistor $Tr_1$ and the capacitance $C_s$. At that time, potential difference $V_{gs}$ is still lower than $V_{th}$.

First Threshold Correction Period

Next, threshold correction is performed. Specifically, when voltage of the power line PSL is $V_{cc}$, and voltage of the signal line DTL is $V_{ofs}$ (threshold correction signal having a fixed crest value), the write line driver circuit 24 raises voltages of the write lines WSL from $V_{off2}$ to $V_{on}$ so that a selection pulse is applied to each write line WSL ($T_7$). Thus, current $I_d$ flows between the drain and the source of the driver transistor $Tr_1$, and the gate voltage $V_{g1}$ and the source voltage $V_{s1}$ rise due to capacitive coupling between gate-to-drain parasitic capacitance of the driver transistor $Tr_1$ and the capacitance $C_s$. Since the capacitance $C_s$ is extremely small compared with element capacitance of the organic EL element 11, and increase in source voltage $V_{s1}$ is thus small compared with increase in gate voltage $V_{g1}$, potential difference $V_{gs}$ becomes large. When potential difference $V_{gs}$ becomes larger than $V_{th}$, the write line driver circuit 24 lowers voltages of the write lines WSL from $V_{on}$ to $V_{off1}$ ($T_8$). Thus, the gate of the driver transistor $Tr_1$ becomes floating, and threshold correction is thus suspended.

First Threshold Correction Suspension Period

During suspension of threshold correction, for example, sampling of voltage of the signal line DTL is performed in a row (pixel) different from a row (pixel) subjected to the previous threshold correction. At that time, the source voltage $V_{s1}$ is lower than $V_{ofs}-V_{th}$ in the row (pixel) subjected to the previous threshold correction. Therefore, even in the threshold correction suspension period, in the row (pixel) subjected to the previous threshold correction, current $I_d$ flows between the drain and the source of the driver transistor $Tr_1$, and thus the source voltage $V_{s1}$ rises, and the gate voltage $V_{g1}$ also rises through coupling via the capacitance $C_s$.

Second Threshold Correction Period

When the threshold correction suspension period has been finished, threshold correction is performed again. Specifically, when voltage of the signal line DTL is $V_{ofs}$, and threshold correction is thus enabled, the write line driver circuit 24 raises voltages of the write lines WSL from $V_{off1}$ to $V_{on}$ ($T_7$), so that the gate of the driver transistor $Tr_1$ is connected to the signal line DTL. At that time, when the source voltage $V_{s1}$ is lower than $V_{ofs}-V_{th}$ (threshold correction is not completed yet), current $I_d$ flows between the drain and the source of the driver transistor $Tr_1$ until the driver transistor $Tr_1$ is cut off (until the potential difference $V_{gs}$ reaches $V_{th}$). Then, before the signal line driver circuit 23 changes voltage of the signal line DTL from $V_{ofs}$ to $V_{sig}$, the write line driver circuit 24 lowers voltages of the write lines WSL from $V_{on}$ to $V_{off1}$ ($T_8$). Thus, since the gate of the driver transistor $Tr_1$ becomes floating, the potential difference $V_{gs}$ may be kept constant regardless of magnitude of voltage of the signal line DTL.

In the threshold correction period, when the capacitance $C_s$ is charged to $V_{th}$, and the potential difference $V_{gs}$ reaches $V_{th}$, threshold correction is finished. When the potential difference $V_{gs}$ does not reach $V_{th}$, threshold correction and threshold correction suspension are repeatedly performed until the potential difference $V_{gs}$ reaches $V_{th}$.

Writing and μ-Correction Period

When the threshold correction suspension period has been finished, writing and μ-correction are performed. Specifically, when voltage of the signal line DTL is $V_{sig}$, the write line driver circuit 24 raises voltages of the write lines WSL from $V_{off1}$ to $V_{on}$ ($T_9$), so that the gate of the driver transistor $Tr_1$ is connected to the signal line DTL. Thus, gate voltage of the driver transistor $Tr_1$ becomes $V_{sig}$. In this stage, anode voltage of the organic EL element 11 is still lower than the threshold voltage $V_{el}$ of the organic EL element 11, and therefore the organic EL element 11 is cut off. Therefore, current $I_d$ flows into element capacitance of the organic EL element 11, so that the element capacitance is charged, resulting in increase in source voltage $V_{s1}$ by ΔV, and eventually potential difference $V_{gs}$ becomes $V_{sig}+V_{th}-\Delta V$. In this way, writing and μ-correction are concurrently performed.

Light Emission

Finally, the write line driver circuit 24 lowers voltages of the write lines WSL from $V_{on}$ to $V_{off1}$ ($T_{10}$). Thus, the gate of the driver transistor $Tr_1$ becomes floating, so that current $I_d$ flows between the drain and the source of the driver transistor $Tr_1$ and thus the source voltage $V_{s1}$ rises. As a result, the organic EL element 11 emits light with a desired luminance.

In the display device 1 of the embodiment, the pixel circuit 12 of each pixel 13 is subjected to on/off control and thus drive current is injected into the organic EL element 11 of each pixel 13 as in the above way, thereby holes and electrons are recombined, causing light emission, and the light is extracted to the outside. As a result, images are displayed in the display region 10A of the display panel 10.

In the unit scan in the previous display device 100 as shown in FIG. 15, time (waiting time) from time $T_1$ when voltage of the power line PSL rises from $V_{ss}$ to $V_{cc}$ to time $T_2$ when threshold correction is started is different for each of lines in one unit, for example, as shown in FIGS. 16 and 17. For example, when one unit has 30 lines, a difference in waiting time between a first line and a 30th line is 29H. Source voltage $V_s$ gradually lowers during the waiting time, for example, as shown in (F) of FIG. 17, which slowly proceeds due to a capacitive component of an organic EL element 111R and the like, and therefore a slight current flows in the pixel circuit in a period from the time $T_1$ to the time $T_2$. As a result, when one unit has an excessively large number of lines, luminance of the first line is increased from luminance of the final line in the period from the time $T_1$ to the time $T_2$, and consequently a stripe pattern occurs between adjacent units.

Moreover, as source voltage $V_s$ gradually lowers to a predetermined potential in the period from the time $T_1$ to the time $T_2$, gate voltage $V_g$ also gradually lowers, for example, as shown in (E) and (F) of FIG. 17. Since decrease in gate voltage $V_g$ correlates to decrease in source voltage $V_s$, decrease in each of the source voltage $V_s$ and the gate voltage $V_g$ is large in the first line compared with in the final line. Thus, a difference occurs in each of the source and gate voltages between the first and final lines (ΔV, and $\Delta V_g$ in the figure) immediately before time $T_3$ when voltage of the power line PSL rises from $V_{ss}$ to $V_{cc}$. Then, when voltage of the power line PSL rises from $V_{ss}$ to $V_{cc}$ ($T_3$), gate voltages $V_g$ become substantially the same between all lines in one unit. However, the difference ($\Delta V_s$) in source voltage $V_s$ remains between the first and final lines. Since the difference ($\Delta V_s$) in source voltage $V_s$ remains through light emission, luminance is different for each of lines in light emission, leading to occurrence of a stripe pattern between adjacent units.

In this way, the previous method has a difficulty where a stripe pattern occurs between adjacent units due to difference in waiting time for each of lines.

In the display device 1 of the embodiment, first, one, first pulse signal P1 is sequentially applied to a plurality of scan lines WSL in each unit U, so that a plurality of organic EL elements 11 are sequentially stopped in light emission for each of lines (pixel rows). Then, when voltage of the power line PSL1 is $V_{cc}$ and voltage of the signal line DTL is $V_{ers}$, and immediately before the voltage of the power line PSL1 changes from $V_{cc}$ to $V_{ss}$, one or more second pulse signal P2 is applied to each of the write lines WSL1 to WSL3. That is, one or more second pulse signal P2 is applied to each of the write lines WSL1 to WSL3 from stop of light emission to start of threshold correction preparation. This may reduce a difference $\Delta V_s$ in source voltage $V_s$ of the drive transistor $Tr_1$ occurring in each unit U compared with the previous case where the second pulse signal P2 is not applied after stop of light emission. As a result, occurrence of a stripe pattern may be prevented in unit scan.

Modifications

Figure 7:
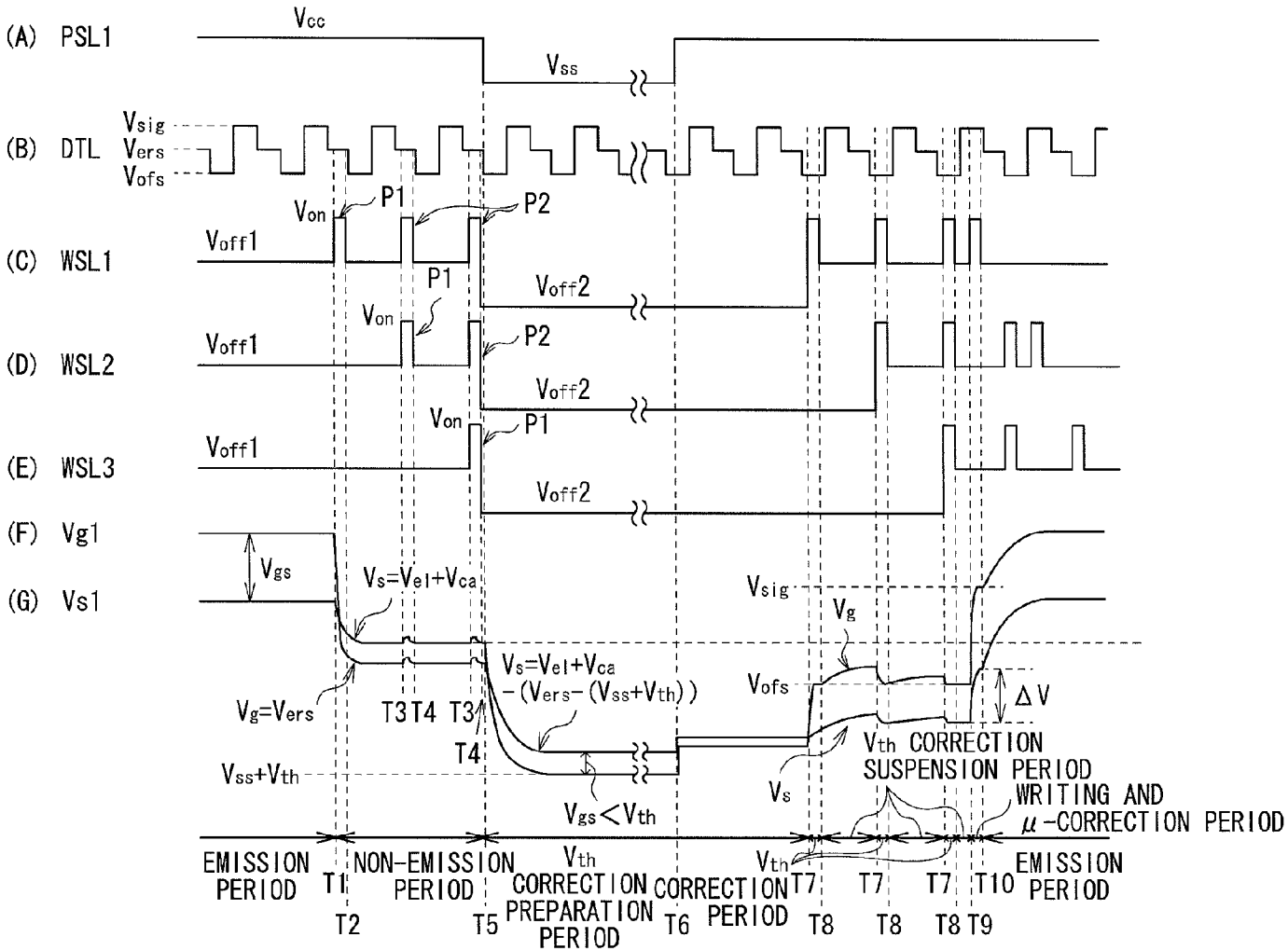
FIG. 7 is a waveform diagram for illustrating still another example of operation in one unit.
Figure 8:
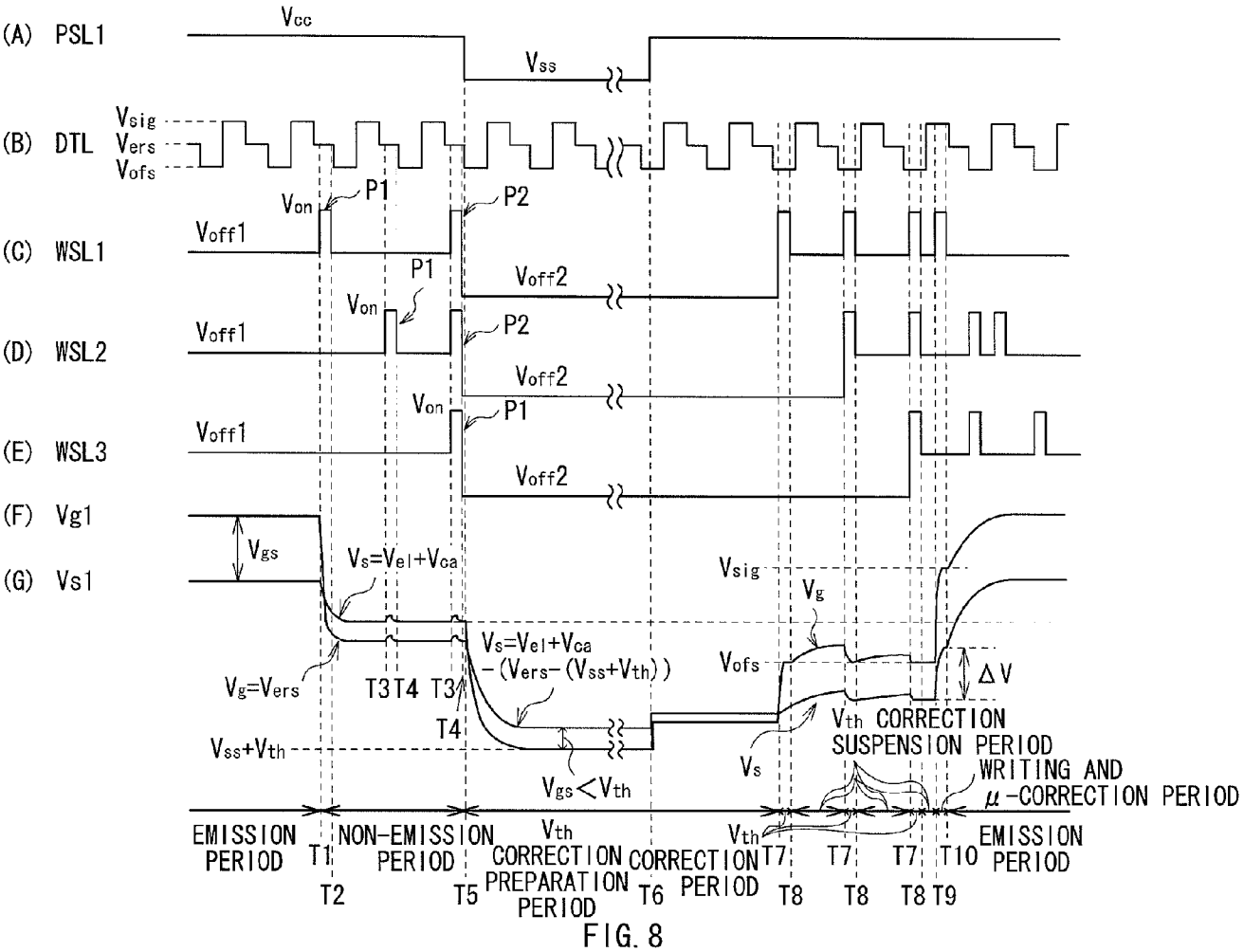
FIG. 8 is a waveform diagram for illustrating still another example of operation in one unit

While the second pulse signal P2 is applied to each of the write lines WSL1 to WSL3 in the embodiment, application of the second pulse signal P2 to the write line WSL3 may be eliminated as necessary (FIGS. 7 and 8). That is, it is acceptable that when voltage of each signal line DTL is $V_{ers}$, one or more second pulse signal P2 is applied to all write lines WSL other than a scan line WSL corresponding to a line (pixel row), being finally stopped in light emission, among the plurality of scan lines WSL in each unit U.

Application of the second pulse signal P2 to the write lines WSL2 and WSL3 may be eliminated as necessary (not shown). That is, it is acceptable that when voltage of each signal line DTL is $V_{ers}$, one or more second pulse signal P2 is applied to a scan line WSL corresponding to at least a line (pixel row), being firstly stopped in light emission, among the plurality of lines (pixel rows) in each unit U.

In the modifications, one of the first and second pulse signals P1 and P2 is preferably finally applied to each of the write lines WSL1 to WSL3 at the same timing (FIGS. 7 and 8).

Module and Application Examples

Hereinafter, application examples of the display device 1 described in the embodiment and the modifications are described. The display device 1 of the embodiment and the like may be applied to display devices of electronic devices in any field for displaying still or video images based on an externally-input or internally-generated video signal, the electronic devices including a television apparatus, a digital camera, a notebook personal computer, a mobile terminal such as mobile phone, and a video camera.

Module

Figure 9:
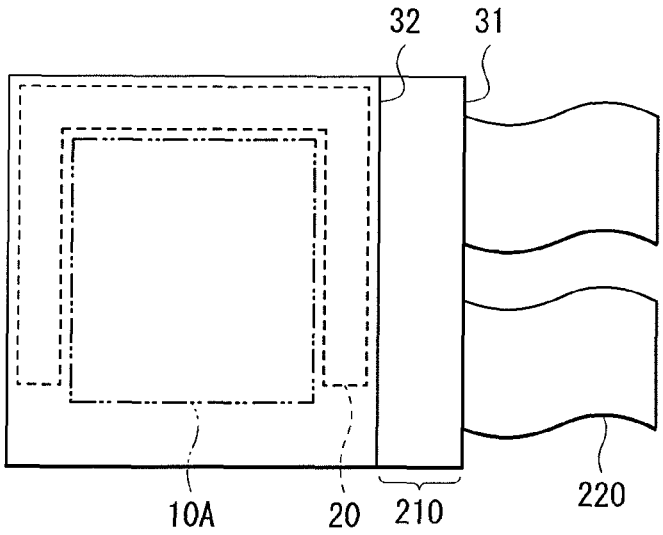
FIG. 9 is a plan diagram showing a schematic configuration of a module including the display device of the embodiment.

The display device 1 of the embodiment and the like may be built in various electronic devices such as application examples 1 to 5 described below, for example, in a form of a module shown in FIG. 9. In the module, for example, a region 210 exposed from a member (not shown) for sealing a display region 10A is provided in one side of a substrate 2, and external connection terminals (not shown) are formed in the exposed region 210 by extending wiring lines of a driver circuit 20. The external connection terminals may be attached with a flexible printed circuit (FPC) 220 for input or output of signals.

Application Example 1

Figure 10:
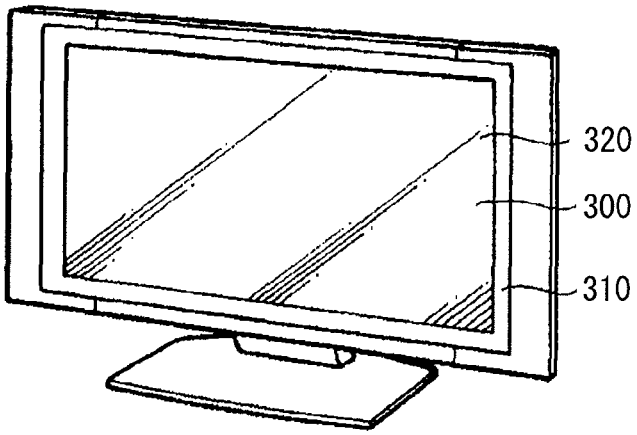
FIG. 10 is a perspective diagram showing appearance of application example 1 of the display device of the embodiment.

FIG. 10 shows appearance of a television apparatus using the display device 1 of the embodiment and the like. The television apparatus has, for example, an image display screen 300 including a front panel 310 and filter glass 320, and the image display screen 300 is configured of the display device 1 according to the embodiment and the like.

Application Example 2

Figure 11A:
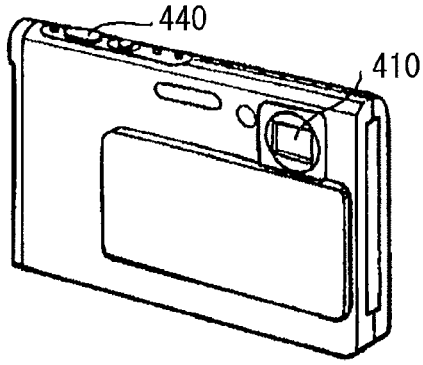
FIGS. 11A and 11B are perspective diagrams, where
Figure 11B:
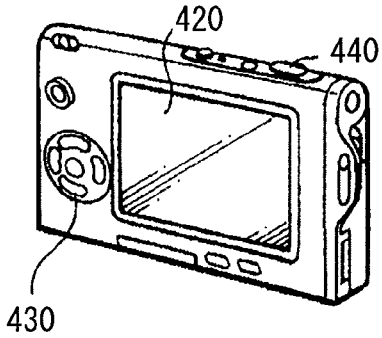

FIGS. 11A and 11B show appearance of a digital camera using the display device 1 of the embodiment and the like. The digital camera has, for example, a light emitting section for flash 410, a display 420, a menu switch 430 and a shutter button 440, and the display 420 is configured of the display device 1 according to the embodiment and the like.

Application Example 3

Figure 12:
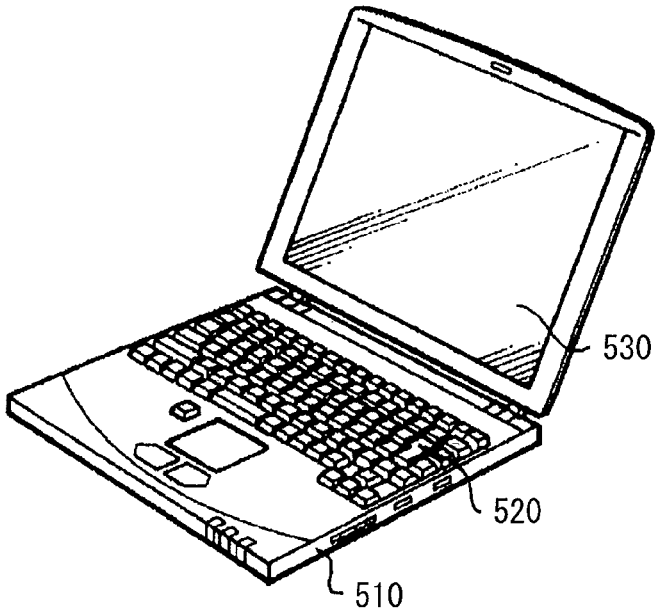
FIG. 12 is a perspective diagram showing appearance of application example 3.

FIG. 12 shows appearance of a notebook personal computer using the display device 1 of the embodiment and the like. The notebook personal computer has, for example, a body 510, a keyboard 520 for input operation of letters and the like, and a display 530 for displaying images, and the display 530 is configured of the display device 1 according to the embodiment and the like.

Application Example 4

Figure 13:
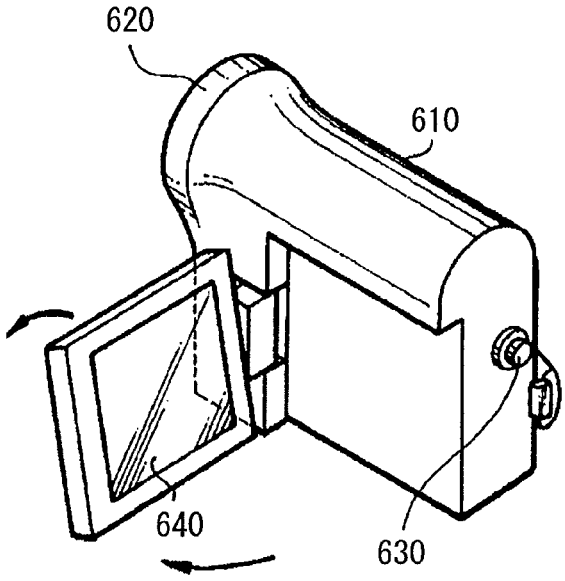
FIG. 13 is a perspective diagram showing appearance of application example 4.

FIG. 13 shows appearance of a video camera using the display device 1 of the embodiment and the like. The video camera has, for example, a body 610, an object-shooting lens 620 provided on a front side-face of the body 610, a start/stop switch 630 for shooting, and a display 640. The display 640 is configured of the display device 1 according to the embodiment and the like.

Application Example 5

FIGS. 14A to 14G show appearance of a mobile phone using the display device 1 of the embodiment and the like. For example, the mobile phone is assembled by connecting an upper housing 710 to a lower housing 720 by a hinge 730, and has a display 740, a sub display 750, a picture light 760, and a camera 770. The display 740 or the sub display 750 is configured of the display device 1 according to the embodiment and the like.

While the application has been described with the embodiment and the application examples hereinbefore, the application is not limited to the embodiment and the like, and various modifications and alterations may be made.

For example, while the embodiment and the like have been described with a case where the display device 1 is an active-matrix display device, a configuration of the pixel circuit 12 for active matrix drive is not limited to those described in the embodiment and the like, and a capacitive element or a transistor may be added to the pixel circuit 12 as necessary. In such a case, a driver circuit to be necessary may be added in addition to the signal line driver circuit 23, the write line driver circuit 24, and the power line driver circuit 25 in correspondence to change in pixel circuit 12.

Moreover, while the timing generator circuit 21 controls drive of each of the signal line driver circuit 23, the write line driver circuit 24, and the power line driver circuit 25 in the embodiment and the like, another circuit may control drive of the circuits. In addition, the signal line driver circuit 23, the write line driver circuit 24, and the power line driver circuit 25 may be controlled by hardware (circuit) or software (program).

Moreover, while the pixel circuit 12 has a circuit configuration of 2Tr1C in the embodiment and the like, the pixel circuit 12 may have any circuit configuration other than 2Tr1C as long as the circuit configuration includes a dual-gate transistor connected in series to the organic EL element 11.

Moreover, while a case where the driver transistor $Tr_1$ and the write transistor $Tr_2$ are formed of n-channel MOS thin film transistors (TFT) has been exemplified in the embodiment and the like, the transistors may be formed of p-channel transistors (for example, p-channel MOS TFT). In such a case, preferably, one of the source and drain of the transistor $Tr_2$, being not connected to the power line PSL, and the other end of the capacitance $C_s$ are connected to the cathode of the organic EL element 11, and the anode of the EL element 11 is connected to GND.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A display device comprising:

a display section including a plurality of scan lines and a plurality of power lines, being arranged in rows, a plurality of signal lines arranged in columns, and a plurality of pixels arranged in a matrix; and a driver section driving each pixel, wherein each pixel has a light emitting element and a pixel circuit, the pixel circuit has a first transistor connected to the power line and controlling a current flowing into the light emitting element, a second transistor connected to the scan line and the signal line and writing a voltage of the signal line to the first transistor, and a capacitor, both of the first and second transistors being connected to a first end of the capacitor, and a second end of the capacitor being connected to the light emitting element, the plurality of power lines are individually provided for each of units with a plurality of pixel rows as a unit, and the driver section sequentially applies one, first pulse signal for stopping light emission of the light emitting element to a plurality of scan lines in each unit, and applies one or more, second pulse signal for turning the second transistor on to at least a scan line corresponding to a pixel row, being first stopped in light emission, among a plurality of pixel rows in each unit while a non-gray-scale signal is applied to each signal line, wherein for each unit, a first voltage is applied to the respective power line of the unit during a non-emission period and is lowered to a second voltage at an end of the non-emission period, said second pulse signals being applied prior to the change from the first voltage to the second voltage.

2. The display device according to claim 1, wherein the driver section applies the one or more, second pulse signal to each scan line while a non-gray-scale signal is applied to each signal line.

3. The display device according to claim 2, wherein the driver section applies second pulse signals, being finally applied to scan lines, to the scan lines at a time in each unit.

4. The display device according to claim 1, wherein the driver section applies the one or more, second pulse signal to all scan lines other than a scan line corresponding to a pixel row, being finally stopped in light emission, among the scan lines in each unit while a non-gray-scale signal is applied to each signal line.

5. The display device according to claim 4, wherein the driver section applies the second pulse signal to all the scan lines other than the scan line corresponding to the pixel row, being finally stopped in light emission, among the plurality of scan lines in each unit, and concurrently applies a first pulse signal to the scan line corresponding to the pixel row, being finally stopped in light emission, among the scan lines in each unit.

6. The display device according to claim 1, wherein the non-gray-scale signal has a voltage value lower than a threshold voltage of the light emitting element.

7. A method of driving a display device, the display device having a display section including a plurality of scan lines and a plurality of power lines, being arranged in rows, a plurality of signal lines arranged in columns, and a plurality of pixels arranged in a matrix, each pixel having a light emitting element and a pixel circuit, the pixel circuit having a first transistor connected to the power line and controlling a current flowing into the light emitting element, a second transistor connected to the scan line and the signal line and writing a voltage of the signal line to the first transistor, and a capacitor, both of the first and second transistors being connected to a first end of the capacitor, and a second end of the capacitor being connected to the light emitting element, the plurality of power lines are individually provided for each of units with a plurality of pixel rows as a unit, wherein one, first pulse signal for stopping light emission of the light emitting element is sequentially applied to a plurality of scan lines in each unit, and one or more, second pulse signal for turning the second transistor on is applied to a scan line corresponding to at least a pixel row, being first stopped in light emission, among a plurality of pixel rows in each unit while a non-gray-scale signal is applied to each signal line, and wherein for each unit, a first voltage is applied to the respective power line of the unit during a non-emission period and is lowered to a second voltage at an end of the non-emission period, said second pulse signals being applied prior to the change from the first voltage to the second voltage.

8. An electronic device comprising:

a display device, the display device having a display section including a plurality of scan lines and a plurality of power lines, being arranged in rows, a plurality of signal lines arranged in columns, and a plurality of pixels arranged in a matrix, and a driver section driving each pixel, wherein each pixel has a light emitting element and a pixel circuit, the pixel circuit has a first transistor connected to the power line and controlling a current flowing into the light emitting element, a second transistor connected to the scan line and the signal line and writing a voltage of the signal line to the first transistor, and a capacitor, both of the first and second transistors being connected to a first end of the capacitor, and a second end of the capacitor being connected to the light emitting element, the plurality of power lines are individually provided for each of units with a plurality of pixel rows as a unit, and the driver section sequentially applies one, first pulse signal for stopping light emission of the light emitting element to a plurality of scan lines in each unit, and applies one or more, second pulse signal for turning the second transistor on to a scan line corresponding to at least a pixel row, being first stopped in light emission, among a plurality of pixel rows in each unit while a non-gray-scale signal is applied to each signal line,.

wherein for each unit, a first voltage is applied to the respective power line of the unit during a non-emission period and is lowered to a second voltage at an end of the non-emission period, said second pulse signals being applied prior to the change from the first voltage to the second voltage.

* * * * *